US009670882B2

(12) United States Patent
Kuske et al.

(10) Patent No.: US 9,670,882 B2
(45) Date of Patent: Jun. 6, 2017

(54) LOW-PRESSURE EGR VALVE

(71) Applicant: Ford Global Technologies, LLC, Dearborn, MI (US)

(72) Inventors: Andreas Kuske, Geulle (NL); Christian Winge Vigild, Aldenhoven (DE); Daniel Roettger, Eynatten (BE)

(73) Assignee: Ford Global Technologies, LLC, Dearborn, MI (US)

( * ) Notice: Subject to any disclaimer, the term of this patent is extended or adjusted under 35 U.S.C. 154(b) by 205 days.

(21) Appl. No.: 14/595,716

(22) Filed: Jan. 13, 2015

(65) Prior Publication Data

US 2015/0198119 A1 Jul. 16, 2015

(30) Foreign Application Priority Data

Jan. 16, 2014 (DE) ..... 10 2014 200 698

(51) Int. Cl.

| | |
|---|---|
| ***F02M 25/07*** | (2006.01) |
| ***F02M 26/74*** | (2016.01) |
| ***F02M 26/06*** | (2016.01) |
| ***F02M 26/21*** | (2016.01) |
| ***F02M 26/71*** | (2016.01) |

(52) U.S. Cl.

CPC ..... *F02M 25/0709* (2013.01); *F02M 26/06* (2016.02); *F02M 26/21* (2016.02); *F02M 26/71* (2016.02); *F02M 26/74* (2016.02)

(58) Field of Classification Search

CPC ..... F02M 26/06; F02M 26/21; F02M 26/74; F02M 25/0709; F02M 26/65; F02C 3/34

USPC ..... 60/605.2; 123/568.17–568.18

See application file for complete search history.

(56) References Cited

U.S. PATENT DOCUMENTS

| | | | | |
|---|---|---|---|---|
| 8,261,725 | B2 * | 9/2012 | Furukawa | F16K 35/14 123/568.17 |
| 2008/0223038 | A1 | 9/2008 | Lutz et al. | |
| 2013/0025576 | A1 * | 1/2013 | Busato | F02M 26/16 123/568.11 |

FOREIGN PATENT DOCUMENTS

DE 102010008012 A1 11/2010

* cited by examiner

*Primary Examiner* — Phutthiwat Wongwian
*Assistant Examiner* — Jason T Newton
(74) *Attorney, Agent, or Firm* — Julia Voutyras; McCoy Russell LLP

(57) ABSTRACT

An EGR valve is provided with a curved connecting surface to allow condensate to flow from an outlet to an exhaust gas inlet of the EGR valve during the use of low-pressure EGR. The curved connecting surface mitigates condensation and/or ice from entering the intake line and impinging on the compressor wheel.

15 Claims, 4 Drawing Sheets

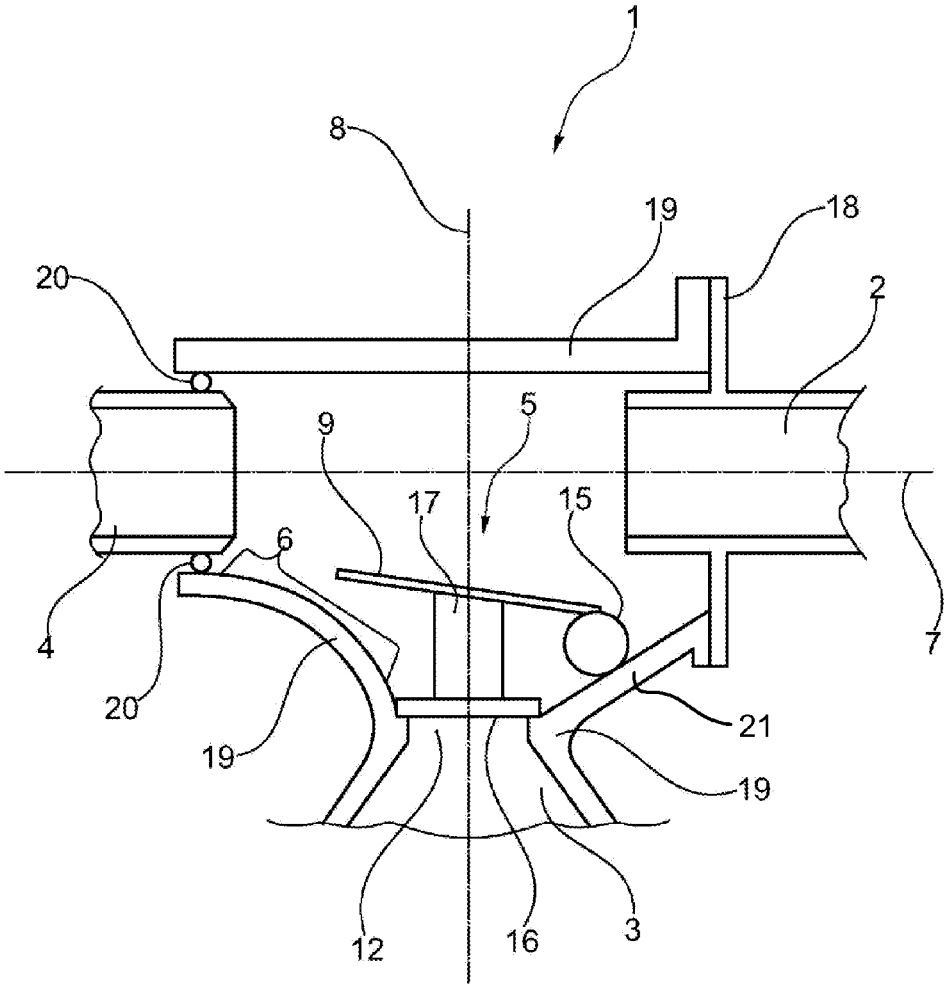
FIG. 2
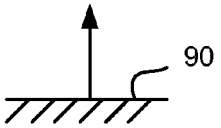

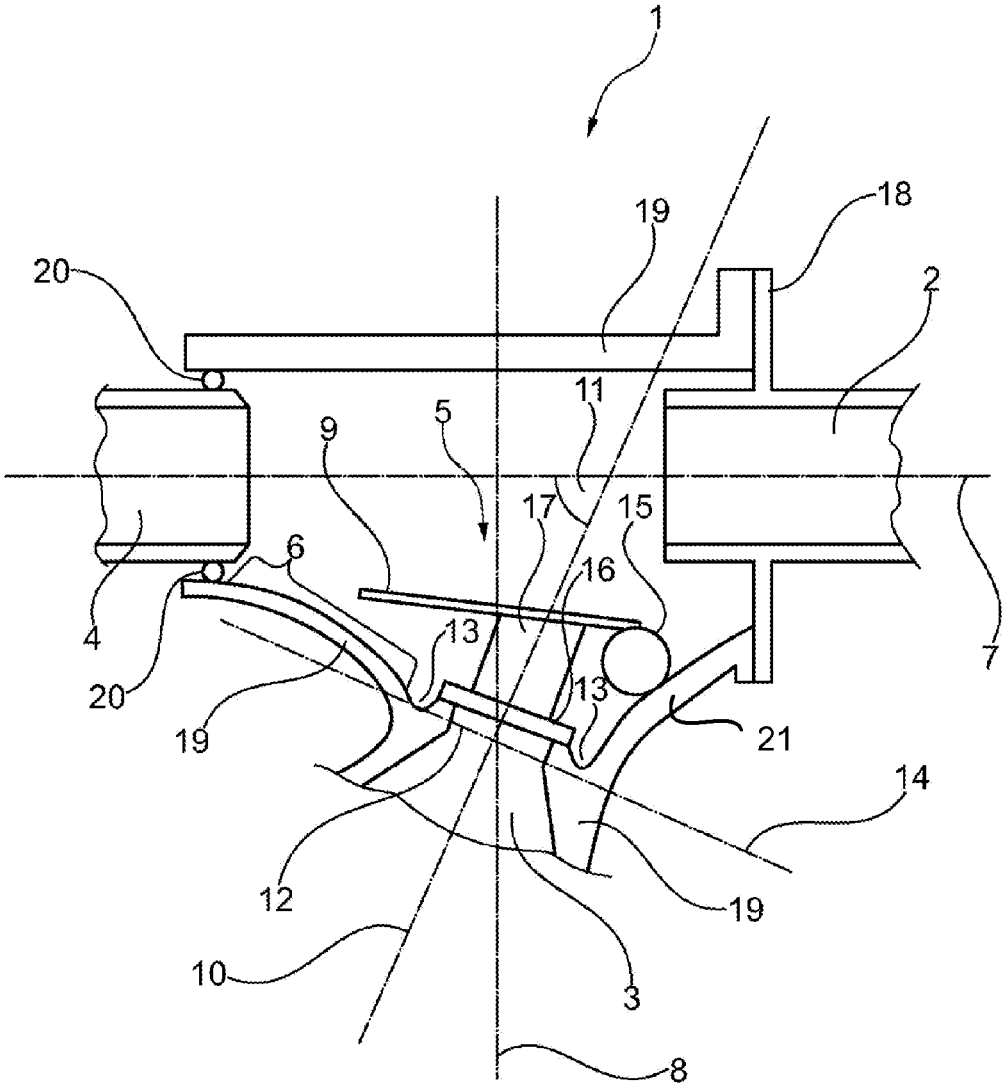
FIG. 3
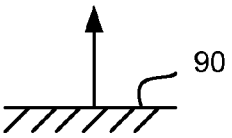

LOW-PRESSURE EGR VALVE

CROSS REFERENCE TO RELATED APPLICATIONS

The present application claims priority to German Patent Application No. 102014200698.8, "LOW-PRESSURE EGR VALVE," filed Jan. 16, 2014, the entire contents of which are hereby incorporated by reference for all purposes.

FIELD

The present disclosure relates a method and system of a low-pressure EGR valve for a motor vehicle comprising an internal combustion engine, and to a motor vehicle having a low-pressure EGR valve of this kind.

BACKGROUND\SUMMARY

Controlling emissions from a motor vehicle may reduce environmental pollution due to motor vehicle traffic. Emissions of particles, such as nitrogen oxide, may be reduced by mixing some of the exhaust gas formed during the combustion process of the engine with intake air provided to the engine. For example, low-pressure exhaust gas recirculation (EGR) may be provided to reduce nitrogen oxide emissions wherein exhaust gas is introduced downstream of the compressor. However, condensate may form in the exhaust gas during introduction of the exhaust gas to the intake air due to a temperature differential. The condensate may impinge on the compressor wheel of the compressor causing damage.

One example to address the condensate issue is to use high pressure EGR wherein the exhaust gas is introduced upstream of compressor.

However, the inventors herein have recognized potential issues with such systems. Using only high-pressure EGR may reduce the beneficial aspects of EGR.

One potential approach to at least partially address some of the above issues includes a system and method for a low-pressure EGR valve. The low-pressure EGR valve comprises a fresh air inlet, an exhaust gas inlet, an outlet which is connected to a compressor, and at least one throttling device. The at least one throttling device influences a fresh air quantity flowing through the fresh air inlet and an exhaust gas quantity flowing through the exhaust gas inlet. The low-pressure EGR valve may have a connecting surface situated between the outlet and the exhaust gas inlet. The connecting surface may be shaped in such a way that condensate flows from the outlet to the exhaust gas inlet during use of the low-pressure EGR valve as intended.

In one example, a connecting surface may be provided in a low-pressure EGR valve with a curve profile comprising an angle such that the condensate flows from the outlet to the exhaust gas inlet and thus prevents condensate from entering the compressor. The connecting surface curve profile may be such that the condensate overcomes any opposing forces which may prevent the condensate from flowing away from the outlet. In this way, it may be possible to reduce the effect of condensate while continuing to enable accurate control of EGR flow.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows a first illustrative embodiment of a low-pressure EGR valve according to the current application.

FIG. 3 shows a second illustrative embodiment of a low-pressure EGR valve according to the current application.

DETAILED DESCRIPTION

Figure 1:
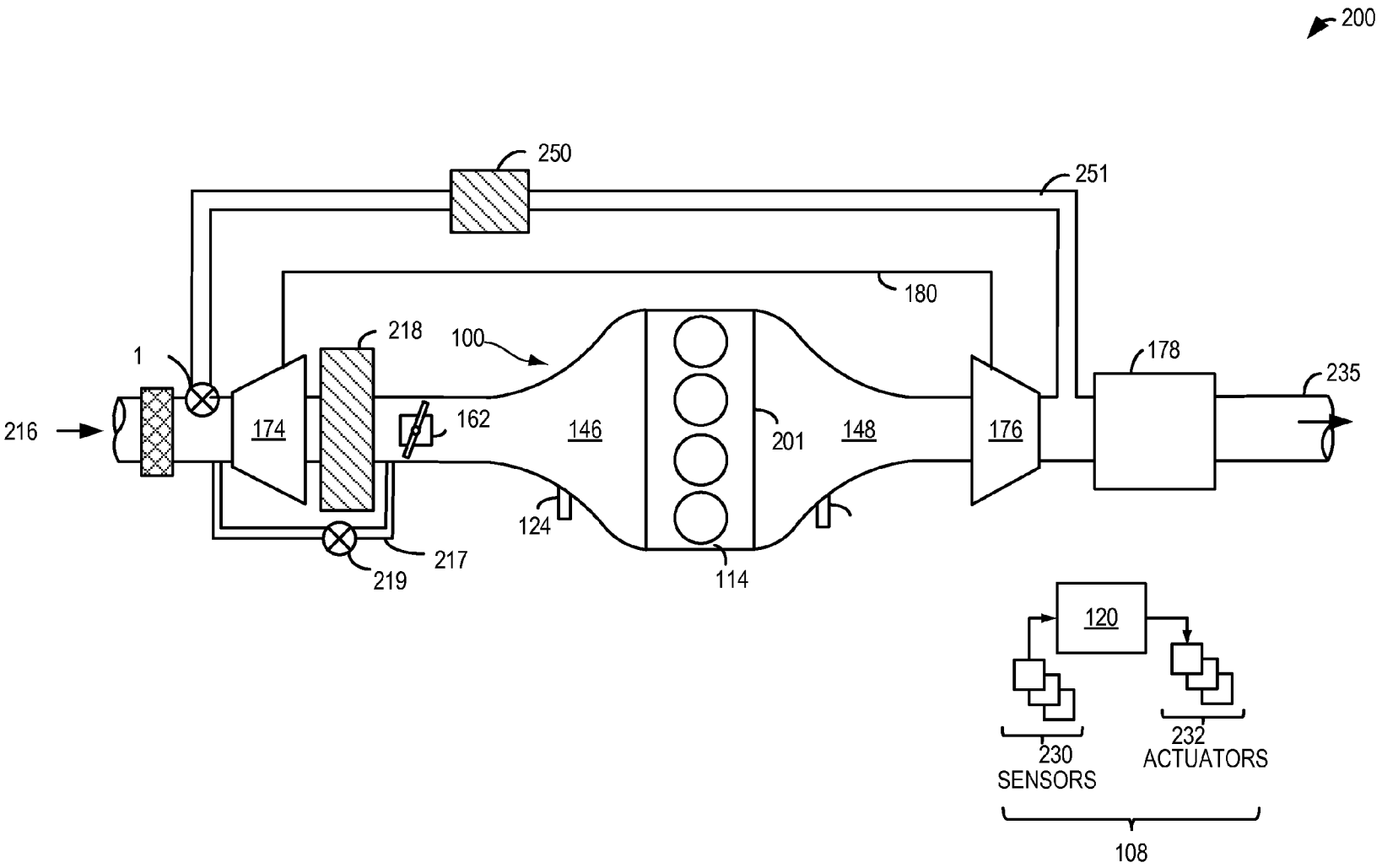
FIG. 1 schematically depicts an example vehicle system including low-pressure EGR.

The emissions from motor vehicles are subject to legal provisions aimed at reducing environmental pollution due to motor vehicle traffic. This applies especially to emissions of fine dust, such as soot particles, and of nitrogen oxides. One widespread approach to reducing nitrogen oxide emissions envisages mixing some of the exhaust gas formed during the combustion of the fuel in the internal combustion engine with the combustion air for the internal combustion engine in order in this way to lower the combustion temperature and to carry out combustion of the fuel without excess oxygen. This technique, which is known as exhaust gas recirculation (EGR), may be performed at high or low pressure, i.e. before (high-pressure EGR) or after (low-pressure EGR) exhaust gas passes through an exhaust gas turbine and/or exhaust gas aftertreatment devices. Combinations of high-pressure and low-pressure EGR may also be provided.

For exhaust gas recirculation, exhaust gas is taken from the exhaust gas flow of the internal combustion engine by means of a branch and mixed in with the fresh air by means of an EGR valve to produce the combustion air for the internal combustion engine. Here, the mixing ratio of the fresh air to the exhaust gas may be influenced by means of the EGR valve in order to allow suitable mixing ratios for different driving states. For example, provision may be made to interrupt exhaust gas recirculation at a very high engine output because, in this case, a large amount of fuel is being burnt and as large as possible a quantity of oxygen needs to be fed in with the combustion air. However, in another example, provision may also be made to admix a high proportion of exhaust gas at low engine output in order to carry out combustion of the fuel without excess oxygen.

It is the object of the current application to introduce an improved low-pressure EGR valve.

The current application introduces a low-pressure EGR valve which is equipped with a fresh air inlet, an exhaust gas inlet, an outlet, which is connected or can be connected to a compressor, and at least one throttling device for influencing a fresh air quantity flowing in through the fresh air inlet and an exhaust gas quantity flowing in through the exhaust gas inlet. According to the current application, a connecting surface situated between the outlet and the exhaust gas inlet is shaped in such a way that condensate flows from the outlet to the exhaust gas inlet during use of the low-pressure EGR valve as intended. The shape of the connecting surface may inhibit condensate from entering the outlet and thus the compressor during EGR use. Thus, the connecting surface may be an arc, wherein the connecting surface is a smooth curve formed in the EGR valve housing between the outlet and the exhaust gas inlet.

The water vapor contained in the recirculated exhaust gas may condense, especially at low ambient temperatures, due to cooling upon contact with the fresh air fed in through the fresh air inlet in the low-pressure EGR valve. The condensed water may collect in the low-pressure EGR valve and may even freeze. Further, the compressor connected to the outlet during use of the low-pressure EGR valve as intended contains a compressor wheel which rotates at very high speed and draws in the recirculated exhaust gas and the fresh air. The current application is based on the insight, and incorporates said insight, that the compressor wheel may be damaged if water droplets, condensate, or even ice particles are drawn in and impinge upon the compressor wheel. The low-pressure EGR valve according to the current application has the advantage that condensed water runs away from the outlet during use of the low-pressure EGR valve as intended and may flow out of the low-pressure EGR valve through the exhaust gas inlet. The water may then be carried away via the exhaust section, for example, and discharged to the environment. In another example, the heat from the exhaust gas may vaporize the collected condensate and the water vapor may then be carried away with the combustion air.

Here, "use as intended" should be taken to mean that the low-pressure EGR valve is installed in a motor vehicle and that the motor vehicle is arranged on a level road. According to the current application, the connecting surface is shaped in such a way that, under these conditions, there is a gradient between the outlet and the exhaust gas inlet, allowing the condensate to flow away from the outlet toward the exhaust gas inlet. During use as intended, the outlet thus lies above the exhaust gas inlet.

In some examples, an abscissa passing through the outlet and the fresh air inlet and an ordinate intersecting the abscissa and passing through the exhaust gas inlet can form a coordinate system. In relation to the coordinate system, the connecting surface then has a curve profile which falls monotonically from the outlet to the exhaust gas inlet. The monotonically falling curve profile of the connecting surface has the effect that the condensate flows to the exhaust gas inlet and does not adhere to recesses or the like on the way.

The exhaust gas inlet may be designed to carry the condensate out of the low-pressure EGR valve. However, it is also possible for the condensate to be merely carried away from the outlet toward the exhaust gas inlet so as to be evaporated there by the recirculated exhaust gas, which is normally hot, and carried away with the combustion air. This is advisable, for example, if boundary conditions mean that the low-pressure EGR valve must be positioned in such a way that it is not possible to achieve outflow of the condensate from the low-pressure EGR valve, via the exhaust for example, because of an inadequate gradient. For example, the gradient may be large enough such that the condensate may overcome any frictional forces of the housing material.

The throttling device can be designed to close the exhaust gas inlet in a closure position. The throttling device can furthermore have a shield, which is designed to at least partially shield a surrounding area arranged around the exhaust gas outlet from a gas flow from the fresh air inlet to the outlet in the closure position. In the closure position (and positions of the throttling device in which the exhaust gas inlet is only slightly open), the majority of the fresh air flows into the low-pressure EGR valve, and therefore the risk of condensate or ice formation in the low-pressure EGR valve is at its greatest. If condensate forms in the valve, the shaping of the connecting surface means that this has run off in the direction of the exhaust gas inlet, where it is shielded by the shield from the gas flow, all of which or the majority of which is flowing from the fresh air inlet to the outlet, and therefore there is no risk that droplets or ice particles from the condensate shielded in this way will be sucked into the compressor connected to the low-pressure EGR valve via the outlet.

As one option, the shield is a throttle flap, which is furthermore designed to influence the fresh air quantity flowing in through the fresh air inlet. The throttle flap can be pivotable about a shaft arranged between the exhaust gas inlet and the fresh air inlet, for example, with the result that the throttle flap lies over the exhaust gas inlet to an increasing extent and shields the latter as the fresh air inlet is opened. This arrangement of the shaft has the additional advantage that, by virtue of the relatively short lever length, the exhaust gas inlet can be opened by applying a smaller force if the condensate is frozen than if the condensate were completely or partially frozen solid on the opposite side of the exhaust gas inlet, i.e. the side which is closer to the outlet, as seen from the shaft.

The low-pressure EGR valve according to the current application is optionally designed as a "combination valve", in which the fresh air inlet can be opened and the exhaust gas inlet closed or the fresh air inlet can be closed and the exhaust gas inlet opened simultaneously by means of just one actuator. However, it is also possible to equip the low-pressure EGR valve with a throttle flap for the exhaust gas inlet and for the fresh air inlet, which can each be pivoted about a dedicated shaft and can be moved by a dedicated actuator. Such an arrangement is more complex than a combination valve but offers greater freedom in determining the mixing ratio of the fresh air to the recirculated exhaust gas.

In some embodiments of the low-pressure EGR valve according to the current application, during use of the low-pressure EGR valve as intended a central axis of the exhaust gas inlet can intersect a horizontal line passing through the outlet and the fresh air inlet in a projection onto a vertical section plane through the low-pressure EGR valve in such a way that the central axis and the horizontal line form an acute angle facing the connecting surface. By virtue of this special arrangement, the exhaust gas inlet faces away from the outlet, this having the effect that the condensate collects predominantly on the side of the exhaust gas inlet which is further away from the outlet. This increases the distance between the outlet and the collected condensate, reducing the risk that condensate or ice particles will be drawn into the outlet. These embodiments are advantageous, for example, if the low-pressure EGR valve is operated temporarily with a closed exhaust gas inlet, preventing the condensate from being carried out of the low-pressure EGR valve.

In this case, an opening of the exhaust gas inlet can have provided around it a recess extending from a side of the opening which is closer to the outlet to a side of the opening which is further away from the outlet. This recess simplifies the flow of the condensate to the side of the opening of the exhaust gas inlet which is further away, and it can be designed as a channel, for example.

The recess optionally extends in a continuous contour, e.g. in a ring shape, around the opening of the exhaust gas inlet. The continuous contour extends on both sides of the opening and can thus carry away a larger quantity of condensate. Moreover, the recess on both sides of the opening of the exhaust gas inlet can accept and carry away condensate running off the walls of the low-pressure EGR valve. The recess can extend in a plane to which the central axis of the exhaust gas inlet forms a normal, for example.

A second aspect of the current application relates to a motor vehicle having an internal combustion engine, an air filter, a compressor, a low-pressure exhaust gas recirculation system and a low-pressure EGR valve according to the current application, which is connected to the air filter, the low-pressure exhaust gas recirculation system and the compressor.

The current application is explained in greater detail below with reference to drawings of illustrative embodiments FIG. 1 shows a schematic diagram of a vehicle system 200 with a multi-cylinder engine system 100 coupled in a motor vehicle in accordance with the present disclosure. As depicted in FIG. 1, internal combustion engine 100 includes a controller 120 which receives inputs from a plurality of sensors 230 and sends outputs from a plurality of actuators 232. Engine 100 further includes cylinders 114 coupled to intake passage 146 and exhaust passage 148. Intake passage 146 may include throttle 162. Exhaust passage 148 may include emissions control device 178. Engine 100 is shown as a boosted engine, coupled to a turbocharger with compressor 174 connected to turbine 176 via shaft 180. In one example, the compressor and turbine may be coupled within a twin scroll turbocharger. In another example, the turbocharger may be a variable geometry turbocharger, where turbine geometry is actively varied as a function of engine speed and other operating conditions.

The compressor 174 is coupled through charge air cooler (CAC) 218 to throttle 162. The CAC 218 may be an air-to-air or air-to-water heat exchanger, for example. From the compressor 174, the hot compressed air charge enters the inlet of the CAC 218, cools as it travels through the CAC, and then exits to pass through the throttle valve 162 to the intake manifold 146. Ambient airflow 216 from outside the vehicle may enter engine 10 and pass across the CAC 218 to aid in cooling the charge air. A compressor bypass line 217 with a bypass valve 219 may be positioned between the inlet of the compressor and outlet of the CAC 218. The controller 120 may receive input from compressor inlet sensors such as compressor inlet air temperature, inlet air pressure, etc., and may adjust an amount of boosted air-charge recirculated across the compressor for boost control. For example, the bypass valve may be normally closed to aid in boost development.

Intake passage 146 is coupled to a series of cylinders 114 through a series of intake valves. The cylinders 114 are further coupled to exhaust passage 148 via a series of exhaust valves. In the depicted example, a single intake passage 146 and exhaust passage 148 are shown. In another example, the cylinders may include a plurality of intake passages and exhaust passages to form an intake manifold and exhaust manifold respectively. For example, configurations having a plurality of exhaust passages may enable effluent from different combustion chambers to be directed to different locations in the engine system.

The exhaust from exhaust passage 148 is directed to turbine 176 to drive the turbine. When a reduced turbine torque is desired, some exhaust may be directed through a wastegate (not shown) to bypass the turbine. The combined flow from the turbine and wastegate flows through the emission control device 178. One or more aftertreatment devices may be configured to catalytically treat the exhaust flow, thereby reducing an amount of one or more substances in the exhaust. The treated exhaust may be released into the atmosphere via exhaust conduit 235.

Depending on the operating conditions of the engine, some exhaust gas may be diverted from the exhaust passage downstream of the turbine 176 to an exhaust gas recirculation (EGR) passage 251, through EGR cooler 250 and EGR valve 1, such as the valve described below in FIGS. 2 and 3, to the inlet of the compressor 174. The EGR passage 251 is depicted as a low pressure (LP) EGR system.

Turning to FIGS. 2 and 3, sectional views of a first and a second embodiment of a low-pressure EGR valve is illustrated. The sectional views show the EGR valve along a plane taken through the inlet valve, exhaust gas valve, and the outlet.

Turning to FIG. 2, a first illustrative embodiment of a low-pressure EGR valve 1 is shown according to the current application. The low-pressure EGR valve includes a fresh air inlet 2, an exhaust gas inlet 3 and an outlet 4. In the illustrative embodiments shown, the low-pressure EGR valve 1 has a housing 19, into which the exhaust gas inlet 3 opens. The outlet 4 is recessed into a lateral aperture in the housing 19 and is sealed off gastightly there by a seal 20. The fresh air inlet 2 is formed as part of an insert or inserted piece 18 which forms a wall of the interior of the low-pressure EGR valve 1 and can be secured on the housing 19, e.g. by means of bolts or similar fastening means. This structure has the advantage that the insert 18 can be removed, thereby allowing the interior of the low-pressure EGR valve 1 to be made available easily during production or for maintenance or repair. The housing 19 may be formed as a casting from metal and the insert 18 from plastic. However, many alternative variants of the structure are possible, and therefore the current application should not be regarded as restricted to the housing structure shown in FIGS. 2 and 3.

A throttling device 5 for influencing a fresh air quantity flowing in through the fresh air inlet 2 and an exhaust gas quantity flowing in through the exhaust gas inlet 3 is arranged in the interior of the low-pressure EGR valve 1. In the example shown, the throttling device 5 comprises a first throttle flap 9, which is designed to influence the fresh air quantity flowing in through the fresh air inlet 2. In FIG. 2, the throttling device 5 is in a position in which the fresh air inlet 2 is open to the maximum extent and the exhaust gas inlet 3 is closed. The exhaust gas quantity flowing in through the exhaust gas inlet 3 is influenced by a second throttle flap 16, which closes an opening 12 of the exhaust gas inlet 3, for example, in the illustrative embodiments shown, thus preventing any exhaust gas from flowing into the low-pressure EGR valve. The housing 19 at the opening 12 of the exhaust gas inlet 3 forms a shoulder or ledge, for the second throttle flap 16 to rest when the exhaust gas inlet 3 is closed. The two throttle flaps 9 and 16 are connected to one another by a connecting piece 17 but it is also conceivable to provide a single throttle flap which can close both the fresh air inlet 2 and the exhaust gas inlet 3 in opposite positions of the throttling device 5. It is likewise possible in all embodiments of the current application to provide two throttle flaps 9 and 16 which can be pivoted independently of one another, enabling the fresh air quantity flowing in through the fresh air inlet 2 and the exhaust gas quantity flowing in through the exhaust gas inlet 3 to be influenced independently of one another. In the illustrative embodiment shown, the throttling device 5 has a shaft 15, about which the throttle flaps 9 and 16 can be pivoted by an actuator (not shown). The shaft 15 of the throttling device may be in contact with the housing 19 of the EGR valve 1. The housing between the exhaust gas inlet 3 opening 12 and the insert 18 of the fresh air inlet 2 forms a connecting line 21 wherein the shaft 15 is in contact with the connecting line 21 of the housing 19 wherein the connecting line is between the exhaust gas inlet 3 and the inserted piece 18 of the fresh air inlet 2. The connecting line 21 of the housing 19 is opposite to the connecting surface 6 of the housing 19 of the EGR valve 1. In this example, the connecting line 21 is straight and has no curvature.

During use as intended, the low-pressure EGR valve 1 is aligned in such a way that the exhaust gas inlet 3 is at the bottom and the fresh air inlet 2 and the outlet 4 lie opposite one another at the sides. For example, the low-pressure EGR valve 1 may be aligned such that the exhaust gas inlet 3 is lower than a horizontal plane, an abscissa, 7 intersecting the fresh air inlet 2 and the outlet 4. In this example, the exhaust gas inlet 3 is oriented to be vertical to the level ground. For example, the exhaust gas inlet 3 may be positioned to be at 90 degrees to the level ground. Thus, a central axis 8 of the exhaust gas inlet 3 can intersect a horizontal line 7 passing through the outlet 4 and the fresh air inlet 7 in a projection onto a vertical section through the low-pressure EGR valve 1 in such a way that the central axis 8 and the horizontal line 7 form an angle, for example at 90 degrees.

According to the current application, a connecting surface 6 between the outlet 4 and the exhaust gas inlet 3 is shaped in such a way that condensate flows from the outlet 4 to the exhaust gas inlet 3. Thus, the connecting surface may form an arc between the gastightly seal 20 of the outlet 4 and the opening 12 of the exhaust gas inlet 3 wherein the housing 19 includes a shoulder for the second throttle flap of the throttling device 5 to rest. If appropriate, the condensate may be received by the exhaust gas inlet 3 and in this way carried out of the low-pressure EGR valve 1. For example, the connecting surface 6 can be shaped in such a way that it has a curve profile which falls monotonically, optimally in a strictly monotonic fashion, in relation to a coordinate system comprising an abscissa 7 and an ordinate 8. Thus, the curved plane of the connecting surface 6 allows for the flow of condensate, which may form upon mixing of the exhaust gas and intake air, through the low-pressure EGR valve 1. The connecting surface provides, in one example, a continuous gradient between where the outlet is inserted with the gas-tight seal and the exhaust gas inlet, allowing the condensate to flow away from the outlet toward the exhaust gas inlet. The positioning of the connecting surface 6 may prevent or reduce the change of condensate from entering the outlet 4.

The first throttle flap 9 of the throttling device 5 may be shaped and arranged in such a way that as far as possible it shields the region around the opening 12 of the exhaust gas inlet 3 from a gas flow flowing from the fresh air inlet 2 to the outlet 4 when the fresh air inlet 2 is wide open, ensuring that condensate which collects in the region around the opening 12 of the exhaust gas inlet 3 or is frozen solid there is not taken along into the outlet 4 with the gas flow. Thus, the first throttle flap 9 may protect the condensate which has formed from being carried away with the intake air entering through the fresh air inlet 2 to the outlet 4.

The EGR valve 1 as illustrated in FIG. 2 provides a connecting surface 6 formed between the gas tightly seal 20 of the outlet 4 and the opening 12 of the exhaust gas inlet 3 and is further opposite of the fresh air inlet 2. The connecting surface 6 is protected from the fresh air entering the EGR valve 1 by the throttle plate 9. Further, the curved shape of the connecting surface of the housing promotes the flow of any condensate which may form away from the outlet 4 to the exhaust gas intake thereby protecting the compressor from condensate and/or ice which may form during low-pressure EGR use. The shaft 15 of the throttling device 5 is positioned on the connecting line 21, which opposed the connecting surface 6. Positioning the shaft on the opposite side of the housing 19 from the connecting surface 6 where condensate forms better enables operation of the throttling device 5, as ice formation may impair the movement of the shaft 15.

FIG. 3 shows a second illustrative embodiment of a low-pressure EGR valve 1 according to the current application. Here, the same reference signs designate the same or functionally similar parts, and therefore what has been stated in respect of the first illustrative embodiment also applies to the second illustrative embodiment unless expressly indicated otherwise. The essential distinguishing feature of the second illustrative embodiment of the current application is that the exhaust gas inlet 3 is arranged in the low-pressure EGR valve 1 in such a way that the opening 12 of the exhaust gas inlet 3 faces away from the outlet 4 and toward the fresh air inlet 2. This leads to the condensate that forms collecting on the side of the exhaust gas inlet 3 which is further away from the outlet 4 and hence at a point further away from the outlet 4 when the exhaust gas inlet 3 is closed in operation. As a result, the condensate is less likely to be drawn in a liquid or frozen state into the outlet 4, where it could damage the compressor. If the exhaust gas inlet 3 is opened again, the condensate can flow out through the exhaust gas inlet 3 or can be evaporated by the hot exhaust gas flow flowing in through the exhaust gas inlet 3 and be carried away with the combustion air.

An optional recess 13 is also shown in FIG. 3, said recess being provided in the wall of the housing 19 in a ring, or annular, shape around the opening 12 of the exhaust gas inlet 3 for example, wherein the recess extends in a plane 14 to which a central axis 10 of the exhaust gas inlet 3 forms a surface normal. However, other shapes for such a recess 13 are possible according to the conditions of the respective individual case. Owing to the alignment of the exhaust gas inlet 3 away from the outlet 4, the central axis 10 of the exhaust gas inlet 3 forms an acute angle 11 with the abscissa 7, which should be arranged horizontally during use of the low-pressure EGR valve 1 as intended. The acute angle may be less than 90 degrees. In this example, the connecting surface 6 shows a curved plane which directs any condensate to the recess 13. The recess, for example in the shape of a ring, forms a channel to collect condensate. In FIG. 3, the connecting surface forms an arc between the gastightly seal 20 and the recess 13 formed around the opening of the exhaust gas inlet 3.

The recess 13 of the second illustrative embodiment of the current application has the advantage that condensate which reaches the recess 13 on the side of the opening 12 which is closer to the outlet 4 is guided around the opening 12, which is closed by the second throttle flap 16 if appropriate, to the side of the opening 12 of the exhaust gas inlet 3 which is further away from the outlet 4. In this case, the recess 13 can be shaped in such a way on the side which is closer that, when the second throttle flap 16 is open, all the condensate can flow out of the recess 13 into the exhaust gas inlet 3, it being possible to achieve this, for example, by arranging the recess 13 on the side of the opening 12 of the exhaust gas inlet 3 which is further away from the outlet 4, at the point thereof which is lowest during use as intended, above or level with the upper rim, situated on the side which is further away, of the exhaust gas inlet. Thus, the connecting surface 6 allows for the flow of condensate away from the exhaust gas inlet into the recess 13 wherein the recess directs the condensate to a side further away from the outlet 4 and closer to the fresh air inlet 2. The curvature of the connecting surface 6 provides an arc which allows for the flow of any condensate formed to be directed away from the outlet 4.

The EGR valve 1 as illustrated in FIG. 3 provides a connecting surface 6 extending from the gas tightly seal 20 to the recess 13 surrounding the exhaust gas inlet 3. As described above, in this embodiment the exhaust gas inlet is oriented at an angle less than the normal to the horizontal plane 7 extending through the fresh air inlet 2 and the outlet 4, which is joined at the gas tightly seal 20 to the EGR valve 1 housing 19. The connecting surface 6 is positioned opposite the housing connecting line 21. The recess 13 provided directs condensate which flowed from the connecting surface 6 further away from the outlet. Further, as described previously, the shaft 15 of the throttling device is positioned in the housing adjacent to the fresh air inlet 2. The shaft 15 is supported on the connecting line 21.

Figure 4:
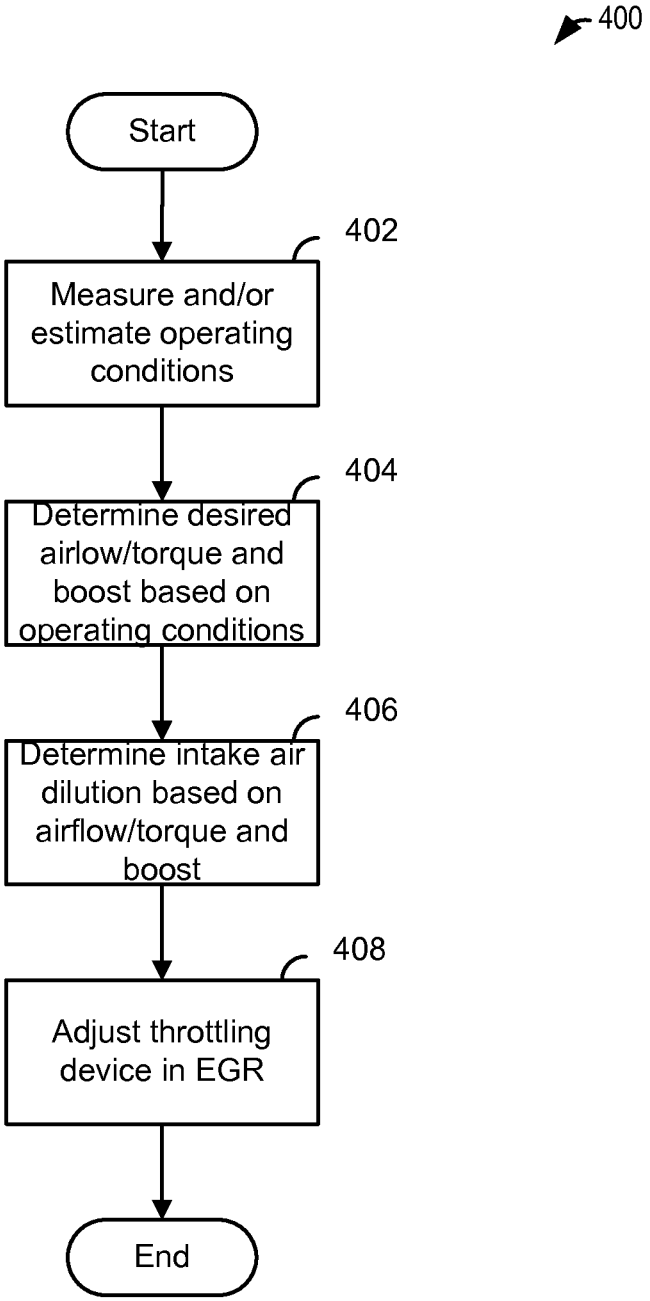
FIG. 4 shows an example operating routine for a low-pressure EGR system.

Turning now to FIG. 4, an example operating routine 400 for a low-pressure EGR system is shown. The low-pressure EGR system may include a valve as described above in FIGS. 2 and 3.

At 402, the method may determine the operating conditions. The operating conditions may include, for example, ambient temperature and pressure, EGR throttling device position, intake oxygen concentration, engine speed, engine load, engine temperature, pedal position, etc. The operating conditions may be measured and/or estimated.

At 404 the method may determine the desired airflow/torque and boost. The desired airflow/torque and boost may be determined based on the operating conditions determined at 402. For example, desired airflow/torque may be determined based on pedal position. Further desired boost may be determined by referencing boost values corresponding to current engine operating conditions in a lookup table stored in memory, in one example.

At 406, the method may determine the intake air dilution based on the desired airflow/torque and boost. For example, the method may include determining an amount of exhaust to recirculate to the intake system to achieve a desired intake air dilution, wherein the desired intake air dilution may be based on engine speed, engine load, engine temperature, and other engine operating conditions as determined at 404. Further, this may include determining a position of the throttling device including the throttling flaps of the EGR valve described in FIGS. 2 and 3 previously.

At 408, the method may include adjusting the throttling device of the EGR valve. Adjusting the throttling device influences a fresh air quantity flowing in through the fresh air inlet and an exhaust gas quantity flowing in through the exhaust gas inlet of the disclosed EGR valve. Thus, a mixture of fresh air and exhaust gas may be provided to the engine via the compressor. The EGR valve comprises the connecting surface which has a curve profile, allowing for any condensate formation to flow towards the exhaust gas outlet. Thus, the method may provide an optimized mixture of exhaust gas and intake air without concern for condensate formation as the disclosed EGR valve 1 provides a curved connecting surface which directs condensate away from the outlet.

The current application has the advantage that the risk of damage to the compressor wheel of a compressor connected to the low-pressure EGR valve by liquid or frozen condensate is reduced since the condensate is carried away from the outlet of the low-pressure EGR valve, to which the compressor is connected, and if appropriate through the exhaust gas inlet.

Although the current application has been illustrated and described more specifically in detail by means of illustrative embodiments of example embodiments, the current application is not restricted by the examples disclosed. Variants of the current application can be derived by a person skilled in the art from the illustrative embodiments shown without exceeding the scope of protection of the current application as defined in the claims.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A low-pressure exhaust gas recirculation (EGR) valve comprising:

a fresh air inlet;

an exhaust gas inlet;

an outlet, which is connected to a compressor; and at least one throttling device comprising a first throttle flap and a second throttle flap for influencing a fresh air quantity flowing in through the fresh air inlet and an exhaust gas quantity flowing in through the exhaust gas inlet;

wherein a connecting surface situated between the outlet and the exhaust gas inlet is shaped in such a way that condensate flows from the outlet to the exhaust gas inlet, wherein the low-pressure EGR valve is coupled to a low-pressure EGR passage flowing exhaust gas formed by an engine, and wherein the second throttle flap of the throttling device is designed to close the exhaust gas inlet in a closure position, and in which the first throttle flap of the throttling device is a shield which is designed to at least partially shield a surrounding area arranged around the exhaust gas inlet from a gas flow from the fresh air inlet to the outlet in the closure position, and wherein an abscissa passing through the outlet and the fresh air inlet and an ordinate intersecting the abscissa and passing through the exhaust gas inlet form a coordinate system, and in which, in relation to the coordinate system, the connecting surface has a curve profile which falls monotonically from the outlet to the exhaust gas inlet.

2. The low-pressure EGR valve of claim 1, wherein the exhaust gas inlet is designed to carry the condensate out of the low-pressure EGR valve.

3. The low-pressure EGR valve of claim 1, wherein the first throttle flap is furthermore designed to influence the fresh air quantity flowing in through the fresh air inlet.

4. The low-pressure EGR valve of claim 1, wherein, during use of the low-pressure EGR valve as intended, a central axis of the exhaust gas inlet intersects a horizontal line passing through the outlet and the fresh air inlet in a projection onto a vertical section plane through the low-pressure EGR valve in such a way that the central axis and the horizontal line form an acute angle facing the connecting surface.

5. The low-pressure EGR valve of claim 1, wherein an opening of the exhaust gas inlet has provided around it a recess extending from a side of the opening which is closer to the outlet to a side of the opening which is further away from the outlet.

6. The low-pressure EGR valve of claim 5, wherein the recess extends in a continuous contour around the opening of the exhaust gas inlet.

7. The low-pressure EGR valve of claim 5, in which the recess extends in a plane to which a central axis of the exhaust gas inlet forms a normal.

8. A low-pressure exhaust gas recirculation (EGR) valve of an internal combustion engine, comprising:

both fresh air and exhaust gas inlets;

an outlet;

a throttle; and an internal curved connecting surface situated within the low-pressure EGR valve and having a continuous gradient between the outlet and the exhaust gas inlet that has a curve profile which falls monotonically from the outlet to the exhaust gas inlet, wherein the low-pressure EGR valve is coupled to a low-pressure EGR passage flowing exhaust formed by the internal combustion engine.

9. The low-pressure EGR valve of claim 8, further comprising a seal.

10. The low-pressure EGR valve of claim 9, wherein the throttle is positionable in a closure position.

11. The low-pressure EGR valve of claim 9, wherein the throttle has a shield.

12. The low-pressure EGR valve of claim 11, wherein the shield is shaped as a throttle flap to influence a fresh air quantity flowing in through the fresh air inlet.

13. The low-pressure EGR valve of claim 12, wherein an opening of the exhaust gas inlet has a recess around it and extends from a side of the opening which is closer to the outlet to another side of the opening which is further away from the outlet.

14. The low-pressure EGR valve of claim 13, wherein the recess extends in a continuous contour around the opening of the exhaust gas inlet.

15. A system, comprising:

a turbo-charged internal combustion engine; and a low-pressure exhaust gas recirculation (EGR) valve coupled to a low-pressure EGR passage, the low-pressure EGR passage flowing exhaust gas formed by the turbo-charged internal combustion engine, and the low-pressure EGR valve comprising:

both fresh air and exhaust gas inlets;

an outlet;

a throttle; and an internal curved connecting surface situated within the low-pressure EGR valve and having a continuous gradient between the outlet and the exhaust gas inlet that has a curve profile which falls monotonically from the outlet to the exhaust gas inlet.

* * * * *